US005272976A

United States Patent [19]

Reder et al.

[11] Patent Number: 5,272,976

[45] Date of Patent: Dec. 28, 1993

[54] DOCTOR BLADE

[75] Inventors: Wolfgang O. Reder, Veitshöchheim; Dieter Reinhart, Hettstadt, both of Fed. Rep. of Germany

[73] Assignee: Koenig & Bauer Aktiengesellschaft, Wurzburg, Fed. Rep. of Germany

[21] Appl. No.: 888,648

[22] Filed: May 27, 1992

[30] Foreign Application Priority Data

May 28, 1991 [DE] Fed. Rep. of Germany ..... 4117390

[51] Int. Cl.[5] ..... B41F 31/04

[52] U.S. Cl. ..... 101/366; 101/169; 118/410

[58] Field of Search ..... 101/169, 157, 154, 366; 118/259, 261, 410, 413

[56] References Cited

U.S. PATENT DOCUMENTS

| | | | |
|---|---|---|---|
| 2,018,193 | 8/1931 | Smith | 101/366 |
| 4,688,516 | 8/1987 | Sommer | 118/410 |
| 4,834,018 | 5/1989 | Sollinger et al. | 118/410 |
| 4,873,939 | 10/1989 | Eskelinen | 118/410 |
| 4,945,855 | 8/1990 | Eklund et al. | 118/410 |
| 4,958,561 | 9/1990 | Grosshauser et al. | 101/366 |
| 4,998,474 | 3/1991 | Hauer | 101/366 |
| 5,058,502 | 10/1991 | Kobler et al. | 101/363 |
| 5,072,669 | 12/1991 | Weisbrod et al. | 101/366 |
| 5,121,689 | 6/1992 | Fadner | 101/366 |

FOREIGN PATENT DOCUMENTS

| | | |
|---|---|---|
| 0199520 | 4/1986 | European Pat. Off. . |
| 0278225 | 1/1988 | European Pat. Off. . |
| 0278255 | 1/1988 | European Pat. Off. . |
| 0350839 | 7/1989 | European Pat. Off. . |
| 401036 | 6/1932 | United Kingdom . |

*Primary Examiner*—Edgar S. Burr
*Assistant Examiner*—Lynn D. Hendrickson
*Attorney, Agent, or Firm*—Jones, Tullar & Cooper

[57] ABSTRACT

A doctor blade for an inking unit of a rotary printing press utilizes one or more plates or elastic bars to limit whirl flow of the ink in the distribution chamber. The plate and/or elastic bar partially divides the ink chamber. As a result, the creation of whirls is controlled and limited.

4 Claims, 4 Drawing Sheets

3

DOCTOR BLADE

FIELD OF THE INVENTION

The present invention is directed generally to a doctor blade assembly. More particularly, the present invention is directed to a doctor blade assembly for an inking unit. Most specifically, the present invention is directed to a doctor blade assembly for an inking unit of a rotary printing press. The doctor blade assembly includes an ink pre-distribution chamber from which the ink flows into an ink distribution chamber. A baffle or plate is positioned in the ink distribution chamber and extends generally in the axial direction of the ink screen roller which is inked by the doctor blade. The baffle or plate has a free end which is positioned to extend radially toward, or to contact the surface of the ink screen roller. The plate is effective in reducing the formation of whirls in the ink in the ink distribution chamber and also removes water that may accumulate in the ink distribution chamber.

DESCRIPTION OF THE PRIOR ART

Chambered doctor blades which are used in cooperation with ink distribution rollers are generally known in the art. These chambered doctor blades typically have spaced end plates which define the axial ends of the ink receiving chambers, and spaced working and sealing blades which engage the peripheral surface of the ink distribution roller. Since the ink distribution roller is constantly in motion with respect to the doctor blade and the ink held within the chamber in the doctor blade, there are frequently generated somewhat circular or whirl-shaped flow currents in the ink held in the ink distribution chamber. These ink whirls extend along in the axial direction of the ink roller and have a direction of flow which is the same as the direction of travel of the ink roller through the ink distribution chamber.

Ink whirls created in the ink distribution chamber by an anilox or screened surface ink distribution roller have a generally circular flow direction, as seen in cross-section, and frequently contain entrained air in the center of the whirl. This air has been brought into the ink in the ink distribution chamber of the doctor blade by the cells of the screened surface roller. When the anilox roller rotates at a high circumferential speed, the whirl in the ink increases to the point that the screen roller surface is only incompletely wetted with new ink within the ink chamber of the doctor blade.

The whirl created by the last part of the sealing blade generally in the area of the top edge of the blade may be supplied with a substantial amount of water that is pulled into the ink distribution chamber by the screened surface ink roller. This water may also include entrained air. Again, the result is that the whirl flow pattern created in the ink distribution chamber results in an incomplete wetting of the screen roller with very little new ink.

It will be apparent that a need exists for a doctor blade assembly of the chambered type which will overcome the limitations of the prior art devices. The doctor blade in accordance with the present invention provides such a device and is a significant improvement over prior art devices.

SUMMARY OF THE INVENTION

It is an object of the present invention to provide a doctor blade assembly.

Another object of the present invention is to provide a doctor blade assembly for an inking unit.

A further object of the present invention is to provide a doctor blade assembly for an inking unit of a rotary press.

Yet another object of the present invention is to provide a doctor blade having an ink distribution chamber.

Still a further object of the present invention is to provide a doctor blade assembly having a whirl reducing plate in the ink distribution chamber.

Even another object of the present invention is to provide a doctor blade for an inking unit in which the creation of whirls and the collection of water ar largely avoided.

As will be discussed in detail in the description of the preferred embodiments which will be set forth subsequently, the doctor blade assembly in accordance with the present invention is a chambered doctor blade which includes at least one ink distribution chamber. Ink is fed to the ink distribution chamber through an ink pre-distribution chamber. The ink distribution chamber is provided with a baffle or plate assembly that in a first embodiment has a free end which extends generally in a radially inwardly direction toward the center of the screen roller but does not engage the surface of the screen roller, and in a second embodiment has a resilient element or portion that is brought into engagement with, and is deformed by the surface of the screen roller.

By providing the axially extending and generally radially inwardly directed plate in the ink distribution chamber, the doctor blade in accordance with the present invention has a significant effect on the whirls created in the chamber. When these whirls reach a certain size, they contact the free end of the plate and are disrupted. Air that is apt to be entrained in the whirling ink is evacuated in the vertical direction to the ink trough which supplies the doctor blade with ink.

In the second preferred embodiment of the doctor blade in which the free end of the plate in the ink distribution chamber carries a resilient or elastic member, the placement of the plate in the ink chamber, and the contact of its free end with the screen roller surface results in the constant wetting of the screen roller surface. The now-elliptical shape of the whirl that is formed in the ink distribution chamber enables the ink to reach that part of the ink chamber which is created by the top edge of the sealing blade together with a part of the enveloping surface of the screen roller. Because of the placement of the elastic or resilient strip behind this top edge of the sealing blade, the water and air mixture that is apt to be built up by the screen roller within the ink distribution chamber is destroyed. The distribution of this water and air mixture avoids the formation of so-called water stripe within the printed image.

The doctor blade assembly of the present invention reduces the build up of ink whirls and air-water mixtures in the ink distribution chamber of the doctor blade. It overcomes the limitations of the prior art devices and represents a substantial advance in the art.

BRIEF DESCRIPTION OF THE DRAWINGS

While the novel features of the doctor blade assembly in accordance with the present invention are set forth with particularity in the appended claims, a full and complete understanding of the invention may be had by referring to the detailed description of the preferred embodiment as is presented subsequently, and as illustrated in the accompanying drawing figures, in which:

DESCRIPTION OF THE PREFERRED EMBODIMENTS

Figure 1:
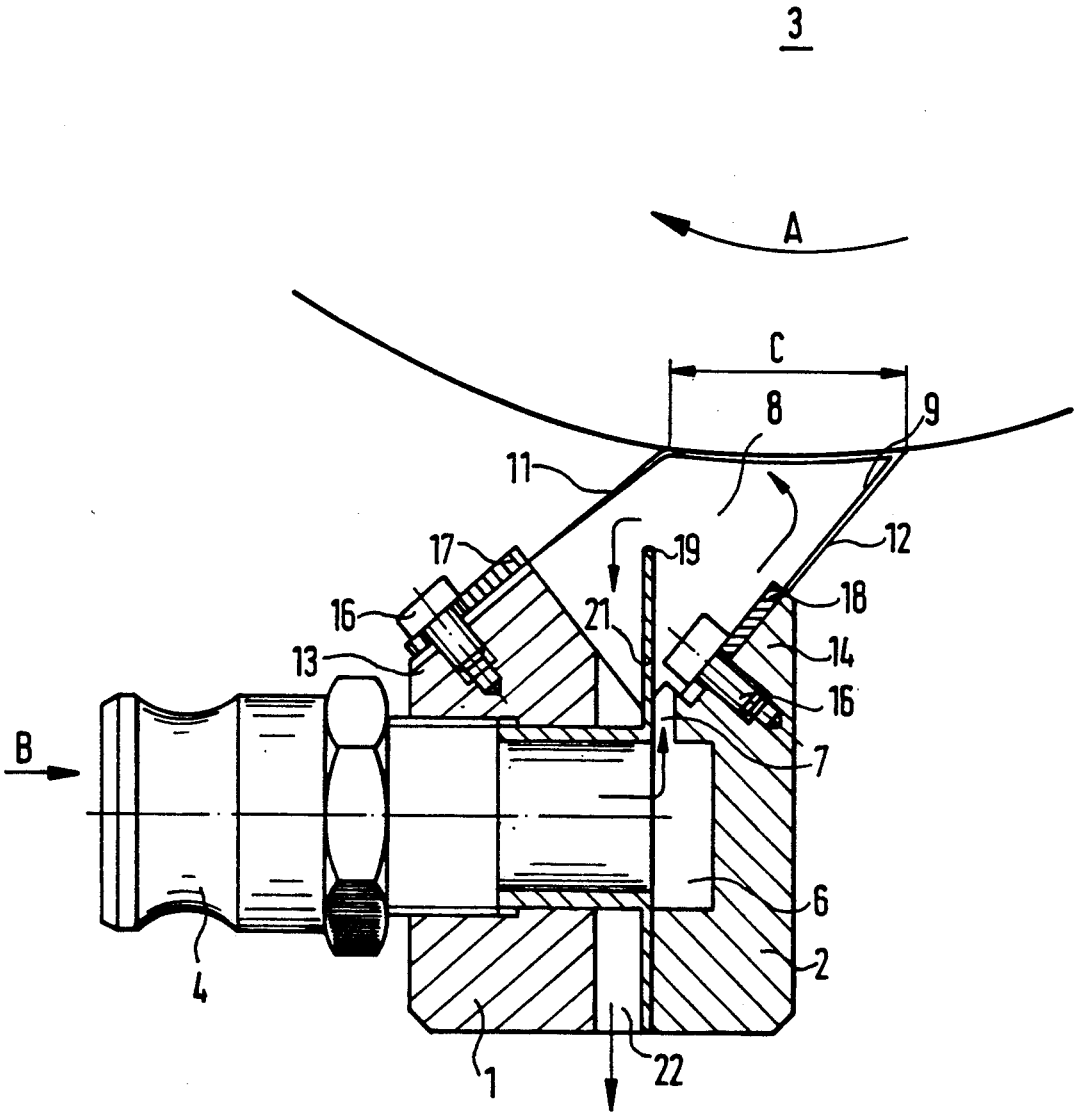
FIG. 1 is a cross-sectional view of a first preferred embodiment of a doctor blade assembly in accordance with the present invention.

Referring initially to FIG. 1, there may be seen a first preferred embodiment of a doctor blade in accordance with the present invention. This first doctor blade or ink application bar includes a base body that is formed of two cooperating base parts 1 and 2. These base parts 1 and 2 are separable along a generally vertical line and are secured to each other by suitable fastening devices, such as screws or the like, which are not specifically shown in the drawings. The base body assembly 1 and 2 extends generally in the axial direction of, and parallel to a rotatable ink screen roller 3 which is rotating in the direction indicated by arrow A in FIG. 1.

An ink inlet connection 4 is secured to either one or the other of ink application bar base elements 1 or 2. As seen in FIG. 1, ink inlet connecting piece 4 is attached to base part 1 and allows printing ink to flow, in the direction indicated by arrow B, into an ink pre-distribution chamber, generally at 6, which is formed in the body portion 2 of the first preferred embodiment of the doctor blade shown in FIG. 1. This ink pre-distribution chamber 6 extends in a generally horizontal direction along the length of the body 2 of the doctor blade assembly. The ink then rises generally vertically through one or more gaps or channels 7 into an ink distribution chamber 8. There may be one or more ink distribution chambers 8 axially along the length of the ink distribution bar. Each chamber 8 is defined by axially spaced parting plates 9 and by a working blade 11 and a sealing blade 12 The sealing blade 12 and the working blade 11 both engage the peripheral surface of the screen roller 3. These blades 11 and 12 are generally parallel to each other and are spaced apart at a distance C, as seen in FIG. 1.

The two base body parts 1 and 2 of the ink distribution bar or doctor blade assembly have angled surfaces 13 and 14, respectively. Each of these angled surfaces support blade holding bars 17 and 18 which are affixed to the surfaces 13 and 14 by suitable screws 16. The inner ends of the working blade 11 and the sealing blade 21 are clamped between the angled surface 13 and the holding bar 17 and the angled surface 14 and the holding bar 18, respectively. The spacing C between the two blades 11 and 12 of the doctor blade assembly seen in FIG. 1 is the wetted length on the enveloping surface of the screen roller 3. As the screen roller 3 passes through this distance C, its surface is wetting with the ink in the doctor blade assembly.

A plate 21 extends generally vertically into the middle of the ink distribution chamber 8 of the doctor blade assembly. In the first preferred embodiment, this plate has a height less than the depth of chamber 8 and thus does not contact the surface of the screen roller 3. Plate 21 is formed at an angle to the working blade 11 and the sealing blade 12. The gap or conduit 7 through which the ink flows from the ink pre-distribution chamber 6 into the ink distribution chamber 8 is located before, in the direction of rotation of roller 3, the plate 21.

As was discussed previously, ink and other materials such as water and air which are brought into chamber 8 by the screen roller 3, are caused to whirl generally in the direction indicated by the arrows in the chamber 8, as seen in FIG. 1. As soon as the magnitude of the whirl flow of the ink and the entrained air and water reaches a certain size or speed, in accordance with increasing circumferential speed of screen roller 3, the whirl will contact the free, upper end 19 of the plate 21. As a result of this contact, the lighter components, such as air and water and ink parts contained within the whirl can be evacuated through a conduit 22 that is in communication with the ink distribution chamber 8 generally adjacent, and after, in the direction of rotation of screen roller 3, the plate 21. The components drawn away through conduit 22 will be directed to a suitable ink trough that is not specifically shown. The position of the plate 21, as depicted in FIG. 1 allows the elliptical creation of the whirl to reach the beginning of the distance C, as seen in the direction of arrow A.

Figure 2:
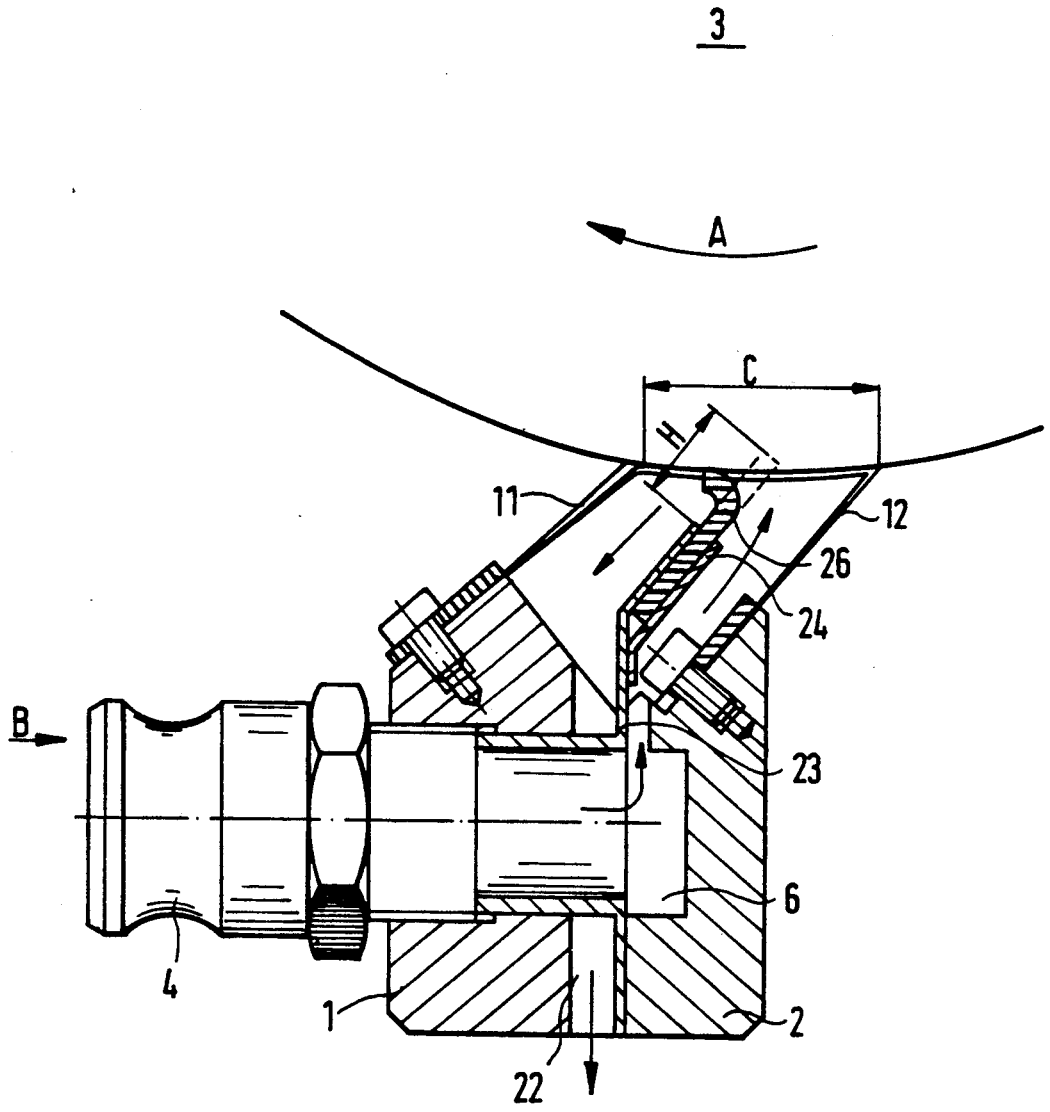
FIG. 2 is a cross-sectional view of a second preferred embodiment of the doctor blade assembly.

Turning now to FIG. 2, there may be seen a second preferred embodiment of a doctor blade or ink distribution bar in accordance with the present invention. In both embodiments, the same numerals are used for corresponding elements. In this second preferred embodiment a plate 23 is located generally in the same position as plate 21 of the first embodiment. The lower end of plate 23 is generally arranged in the radial direction of roller 3 while an upper or free end 24 of plate 23 is generally parallel to the blades 11 and 12. This free end 24 of the plate 23 is generally U-shaped in cross-section and supports an elastic bar or strip 26. This elastic bar 26 is generally parallel to the free end 24 of the plate 23 and to the blades 11 and 12. An inner end of the elastic strip 26 is held in the U-shaped end 24 of the plate 23 while a free, outer end of the strip 26 extends into engagement with, and is deformed by engagement with, the surface of the screen roller 3. The height H of the free end of the strip 26 is such that when the doctor blade assembly shown in FIG. 2 is moved into engagement with the screen roller 3, the free end of the strip 26 is bent or deformed in the direction of rotation of screen roller 3 so that it is deformed toward the working blade 11. As was the case with the plate 21 of the first embodiment, the plate 23, plate free end 24 and elastic strip or bar 26 all extend in the axial direction of the screen roller 3. The elastic bar 26 may be made of a suitable felt or of an elastic or resilient plastic material. The elastic bar or strip 26, which acts as an extension of the plate 23, operates in a manner similarly to plate 21 to disturb and deter the formation of whirls within the ink chamber. Additionally, bar 26 makes sure that the cells of the screen roller 3 are well filled with ink.

Figure 3:
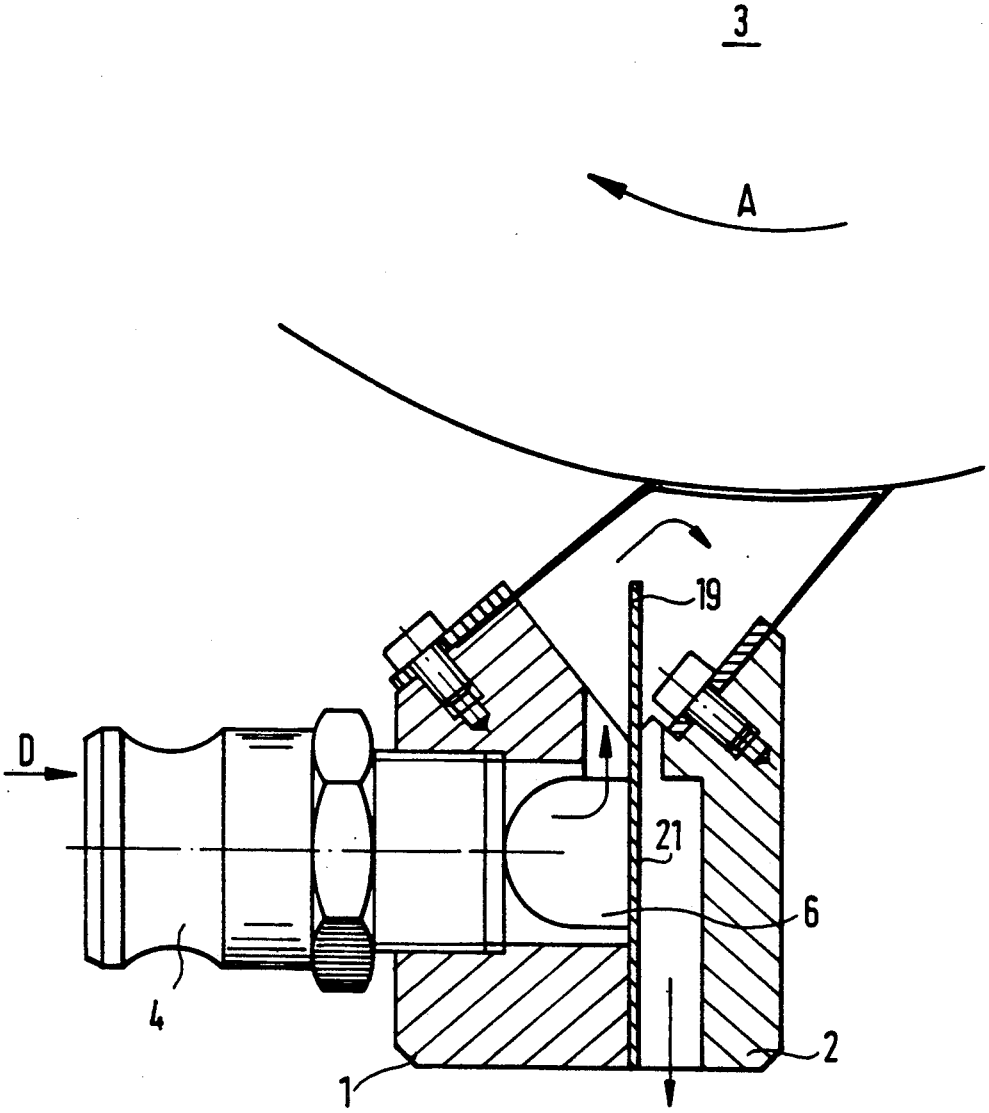
FIG. 3 is a cross-sectional view of a third preferred embodiment of the doctor blade assembly.

Turning now to FIG. 3 there may be seen a third preferred embodiment of a doctor blade or ink distribution bar assembly in accordance with the present invention. The third preferred embodiment is generally similar to the first preferred embodiment with the difference being that the positioning of the ink pre-distribution chamber in the third preferred embodiment is in the body part 1, as opposed to the body part 2 as shown in FIG. 1. This further positions the gap 7 after, in direction of rotation of screen roller 3, and locates the conduit 22 before the plate 21. Thus as depicted in FIG. 3, the ink flow into the ink distribution chamber 8 is generally in the opposite direction to the rotational direction of the screen roller 3.

Figure 4:
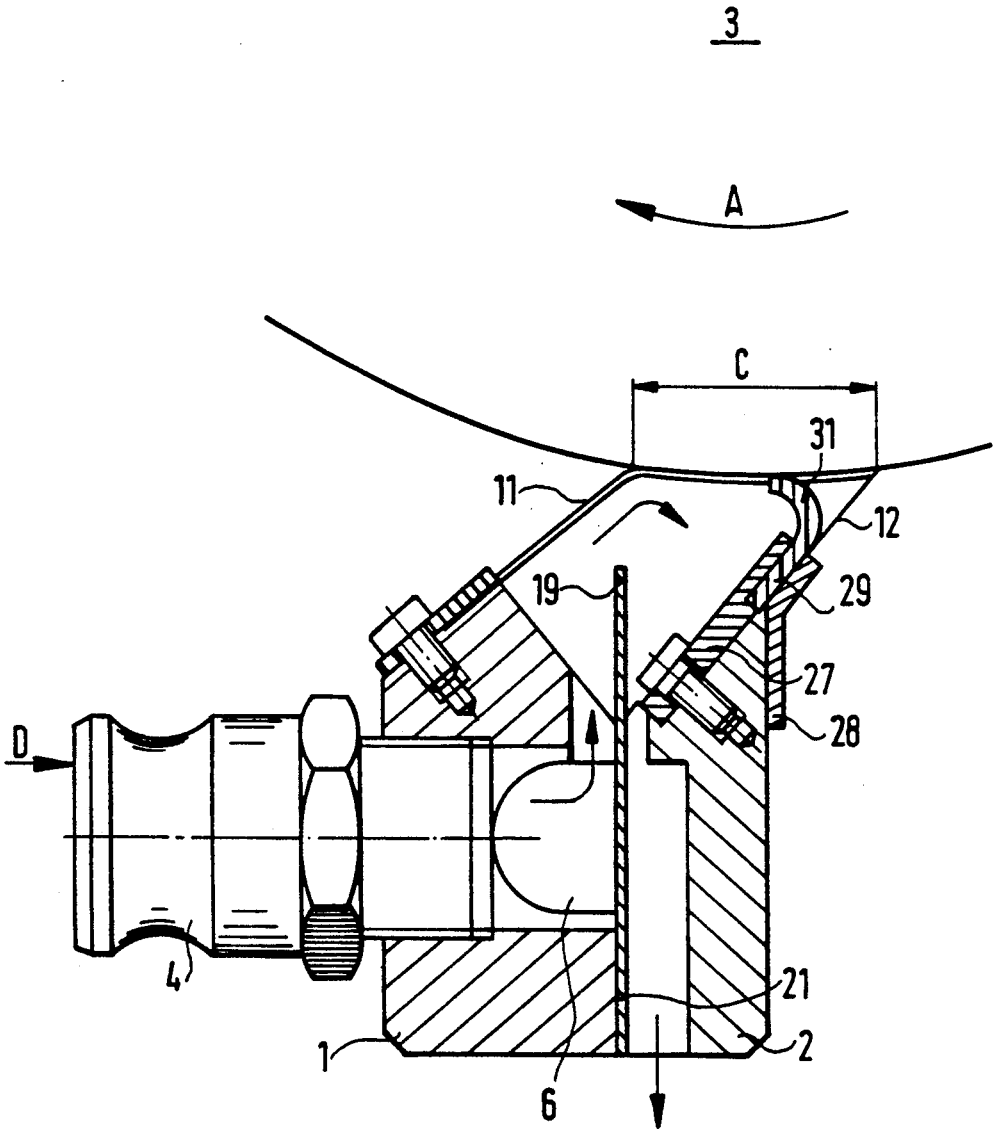
FIG. 4 is a cross-sectional view of a fourth preferred embodiment of the doctor blade assembly in accordance with the present invention.

A fourth preferred embodiment of the doctor blade or ink distribution bar of the present invention is shown in FIG. 4. In this embodiment, there is provided a fixed baffle or plate 21 of the same construction as that discussed above with regard to the third preferred embodiment, together with an elastic bar 29 and a holding bar 27 and angle rack 28 which are generally adjacent and parallel to the sealing blade 12. As with the third embodiment, the ink pre-distribution chamber 6 is in the body part 1 of the base body and the ink flow is in the direction indicated by arrow D in FIG. 4. The holding bar 27 for the elastic strip or bar 29 has a recess at its upper end and this recess cooperates with the angle rail 28 to form an elongated slot that receives the elastic bar or strip 29 which is similar to the corresponding elastic bar or strip 26 discussed in the second preferred embodiment. A free end portion 31 of the elastic bar or strip 29 contacts the surface of the screen roller 3. This embodiment of the doctor blade of the present invention also diminishes whirl in the ink distribution chamber 8 and aids in the destruction of the water film formed by the screen roller 3 in the chamber 8.

The elongated plate 21 depicted in FIGS. 1, 3 and 4 is shown with a smooth, generally continuous free end portion 19. It is also within the scope of the present invention to equip plate 21 with recesses in the axial direction along its length or with projecting bolts on one or both sides of the plate. Alternatively, the plate 21 could have slots along its free end 19 with these slots extending generally in the radial direction of the screen roller to give plate 21 a comb-like configuration.

While preferred embodiment of a doctor blade for an inking unit of a rotary printing press have been set forth fully and completely hereinabove, it will be apparent to one of skill in the art that a number of changes in, for example the size of the screen roller, the type of printing ink used, the means for supplying the printing ink to the doctor blade and the like could be made without departing from the true spirit and scope of the present invention which is accordingly to be limited only by the following claims.

What is claimed is:

1. A doctor blade assembly for an inking unit which supplies printing ink to a screen roller of a rotary printing press, said doctor blade assembly comprising:

a base body having an ink pre-distribution chamber and means to supply printing ink to said ink pre-distribution chamber, an ink distribution chamber positioned above said ink pre-distribution chamber and being in ink flow communication with said ink pre-distribution chamber through a generally vertical gap;

parting plates spaced in the axial direction of the screen roller along said ink distribution chamber and cooperating with a sealing blade and a working blade and a peripheral surface of the screen roller to define said ink distribution chamber;

a plate extending into and partially dividing said ink distribution chamber generally in the direction of the screen roller, said plate extending axially along said chamber and having a free end; and an elastic bar carried by said free end of said plate, said elastic bar having a free height sufficient to cause a free end of said elastic bar to engage the surface of the screen roller and to be deformed by said engagement in the direction of rotation of the screen roller.

2. The doctor blade assembly of claim 1 wherein said elastic bar is felt.

3. The doctor blade assembly of claim 1 wherein said elastic bar is elastic plastic.

4. A doctor blade assembly for an inking unit which supplies printing ink to a screen roller of a rotary printing press, said doctor blade assembly comprising:

a base body having an ink pre-distribution chamber and means to supply printing ink to said ink pre-distribution chamber;

an ink distribution chamber positioned above said ink pre-distribution chamber and being in ink flow communication with said ink pre-distribution chamber through a generally vertical gap;

parting plates spaced in the axial direction of the screen roller along said ink distribution chamber and cooperating with a sealing blade and a working blade and a peripheral surface of the screen roller to define said ink distribution chamber;

an ink whirl reducing plate extending into said ink distribution chamber generally in the direction of the screen roller, said ink whirl reducing plate extending axially along said chamber and having a free end generally parallel to said sealing blade and said working blade, said ink whirl reducing plate partially dividing said ink distribution chamber;

an ink whirl flow in said ink distribution chamber, said ink whirl flow having a flow direction opposite to a direction of rotation of the screen roller; and an elastic bar carried by said free end of said ink whirl reducing plate, said elastic bar having a free height sufficient to cause a free end of said elastic bar to engage the surface of the screen roller and to be deformed by said engagement in the direction of rotation of the screen roller.

* * * * *

UNITED STATES PATENT AND TRADEMARK OFFICE
CERTIFICATE OF CORRECTION

PATENT NO. : 5,272,976

DATED : December 28, 1993

INVENTOR(S) : Wolfgang O. Reder, Dieter Reinhart, and Georg Schneider

It is certified that error appears in the above-identified patent and that said Letters Patent is hereby corrected as shown below:

On the title page of the patent, please correct the listing of inventors to read as follows:

--[75] Inventors: Wolfgang O. Reder, Veitschochheim Fed. Rep. Germany; Dieter Reinhart, Hettstadt Fed. Rep. Germany; Georg Schneider, Wurzburg, Fed. Rep. Germany--

Signed and Sealed this

Thirty-first Day of May, 1994

*Attest:*

Bruce Lehman

BRUCE LEHMAN

*Attesting Officer*

*Commissioner of Patents and Trademarks*